United States Patent [19]

Sullivan

[11] 4,409,700

[45] Oct. 18, 1983

[54] SURFACE CLEANING DEVICE

[75] Inventor: Raymond F. Sullivan, Los Altos, Calif.

[73] Assignee: Hepta Corporation, Los Altos, Calif.

[21] Appl. No.: 274,038

[22] Filed: Jun. 15, 1981

[51] Int. Cl.[3] ..... A47L 13/12

[52] U.S. Cl. ..... 15/121; 15/117; 15/245

[58] Field of Search ..... 15/111, 114, 117, 118, 15/121, 244 R, 245

[56] References Cited

U.S. PATENT DOCUMENTS

| | | | |
|---|---|---|---|
| 834,667 | 10/1906 | Flynn | 15/121 |
| 2,446,401 | 8/1948 | Ziskind | 15/121 |
| 2,649,600 | 8/1953 | Loveland | 15/121 |

FOREIGN PATENT DOCUMENTS

| | | | |
|---|---|---|---|
| 16416 | of 1901 | United Kingdom | 15/121 |
| 344619 | 3/1931 | United Kingdom | 15/121 |

*Primary Examiner*—Edward L. Roberts
*Attorney, Agent, or Firm*—John L. McGannon

[57] ABSTRACT

A device for simultaneously applying a solution to a surface and immediately thereafter wiping the surface free of excess solution. The device includes a handle provided with a pair of end extensions and a hollow member at the end of each extension, respectively. Each hollow member has a slot or opening therethrough facing away from the handle. A wiper member of resilient material is partially received within one of the hollow members and projects outwardly therefrom through said slot thereof. A body of absorbent material, such as sponge material or the like, is partially received in the other hollow member and projects outwardly through the slot thereof. The length of the handle is in the range of 4 to 9 inches so that the wiper member and body can simultaneously engage and move along the surface to be cleaned yet the user has sufficient control of the device to permit rapid cleaning and wiping of the surface in a single pass over the surface.

1 Claim, 5 Drawing Figures

SURFACE CLEANING DEVICE

This invention relates to improvements in the cleaning of surfaces, such as windows or the like, and more particularly, to an improved device which permits almost simultaneously washing and wiping of the surface to be cleaned.

BACKGROUND OF THE INVENTION

In washing of glass window panes in homes and industrial establishments, the surfaces of the panes are first washed by applying a cleaning solution to the entire area of the surface. Then, the excess solution on the surface is wiped with a wiping device, such as a resilient wiping blade. This conventional way of cleaning such a surface requires several steps which are time consuming and often results in puddles of cleaning solution below the surface or near the container which contains the cleaning solution. This is because the person cleaning the surface must first apply the cleaning solution to the entire area of the surface, following which the tool for applying the solution is released and the wiping device is then employed to wipe the surface. This wiping action causes streaks to occur in the surface if the wiping action is not performed sufficiently soon after the cleaning solution is applied to the surface.

For the foregoing reasons, a need has arisen for an improved cleaning device which permits almost immediate wiping of a solution from a surface after a solution has been applied.

SUMMARY OF THE INVENTION

The present invention satisfies the aforesaid need by providing an improved cleaning device which permits the application of a cleaning solution to a surface and almost immediately thereafter the wiping the surface free of excess solution. The device of the present invention can either be hand-held or secured to the outer end of a long pole or rod, whereby the user can manipulate the device and have full control of the movements of both the solution applying means and the wiper means on the device at the same time.

An important aspect of the present invention is the length of the handle to which the wiper member and solution applying means is secured. The handle is of a length in the range of 4 to 9 inches so that full control of both the wiper member and solution applying body can be had at the same time. This permits the wiper member to be sufficiently close to the solution applying body yet they are far enough apart to assure proper application of the cleaning solution to effectively clean the surface.

A primary object of this invention is to provide an improved surface cleaning device in which a solution applying body and a wiper member are carried by a handle which has a length sufficient to permit control of both the body and the member simultaneously so that they can engage the surface to be cleaned at the same time to minimize the time and effort required to clean the surface.

Other objects of this invention will become apparent as the following specification progresses, reference being had to the accompanying drawings for an illustration of the invention.

IN THE DRAWINGS

Figure 1:
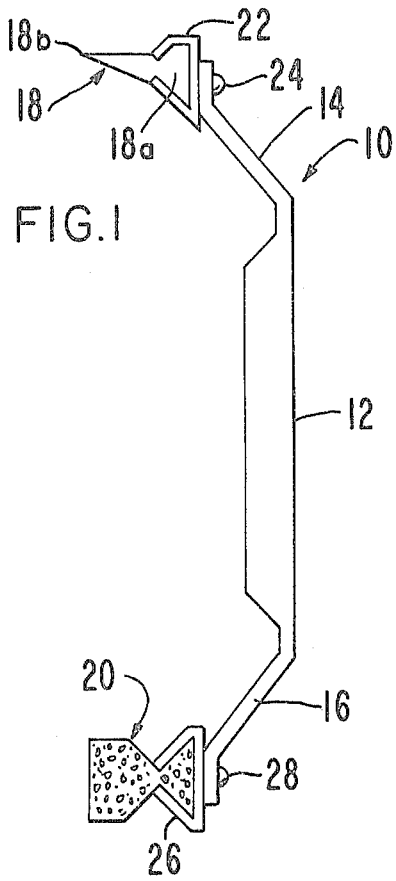
FIG. 1 is a side elevational view of the surface cleaning device of the present invention.
Figure 2:
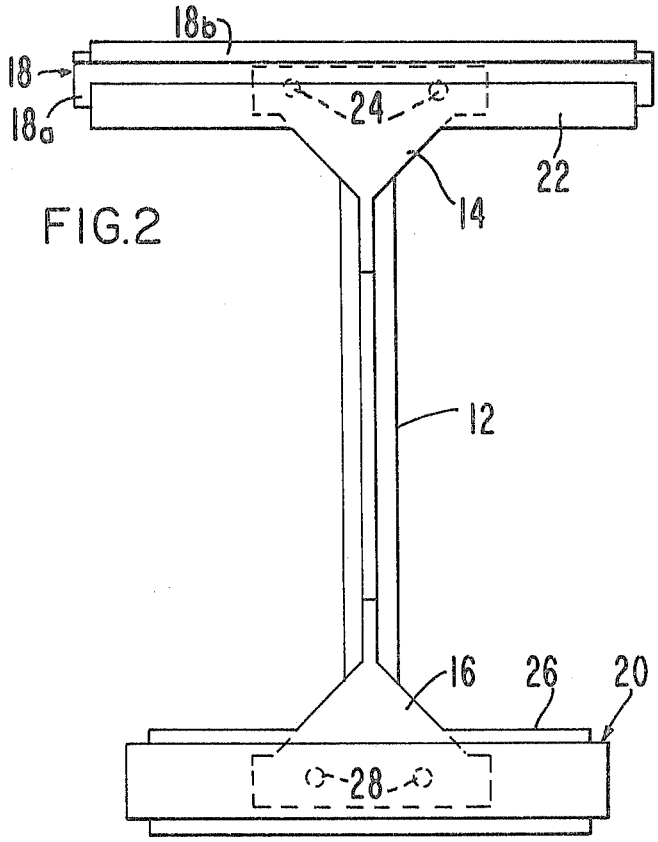
FIG. 2 is a front elevational view of the device.
Figure 3:
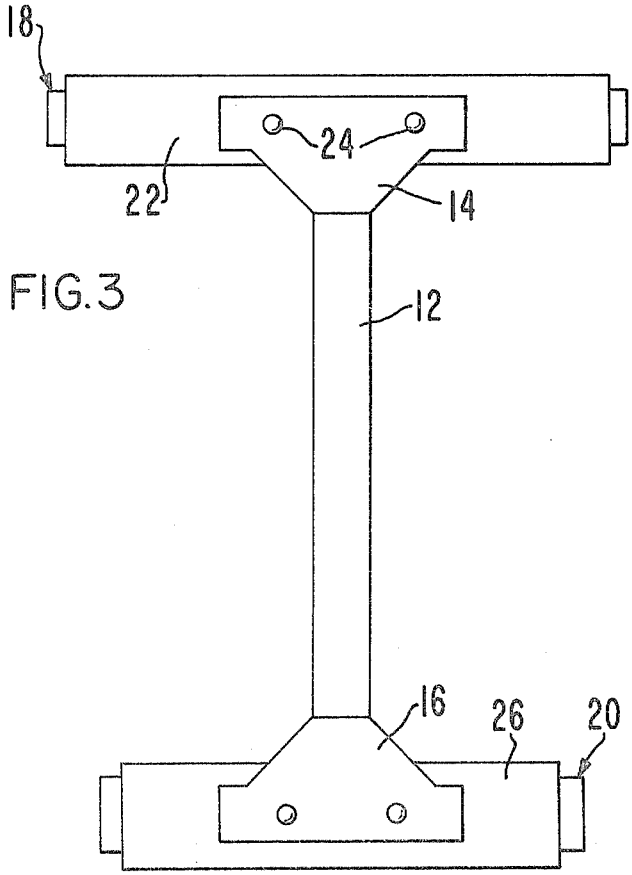
FIG. 3 is a rear elevational view of the device.

The surface cleaning device of the present invention is broadly denoted by the numeral 10 and includes a handle 12 capable of being hand-held. Handle 12 is provided with a normally upper extension 14 and a lower extension 16 which are angled with reference to the longitudinal axis of the handle as shown in FIG. 1.

A wiper member 18 of resilient material, such as rubber, neoprene or the like, is secured in any suitable manner to the outer end of extension 14. An absorbent body 20, such as sponge or plastic foam material, is secured in any suitable manner to the outer end of extension 16. For purposes of illustration, wiper member 18 has a base 18*a* which is received within the interior of a hollow holding element 22 secured by a pair of screws 24 to extension 14. Similarly, body 20 is received within the interior of a hollow holding element 26 secured by a pair of screws 28 to extension 16. Wiper member 18 and body 20 are fixed in position and do not move relative to respective extensions 14 and 16. Member 18 has an outer, pointed end 18*b* for engaging a surface to be wiped after body 20 has applied water for a cleaning solution to the surface. Also, member 18 is longer in length than body 20.

Figure 4:
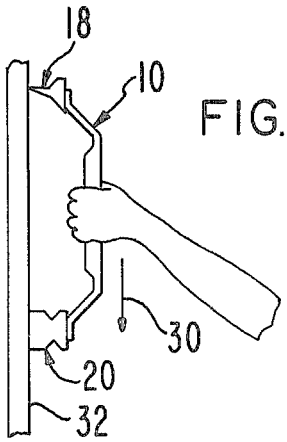
FIG. 4 is a schematic view of the device, showing the way in which it is hand-held during the cleaning of a surface.

Handle 12 is of a length which allows the device 10 to be hand-held in the manner shown in FIG. 4 and moved in the direction of arrow 30 when cleaning a surface 32, such as the surface of the window. The length of the handle is such as to allow full control of wiper member 28 and body 20 at the same time.

Generally, device 10 is used by first dipping body 20 into a solution, such as water or a soapy solution. Then body 20 is brought into engagement with surface 22 near the upper extremity thereof, during which time wiper member 18 is spaced away from the surface until body 20 has moved downwardly along and in engagement with surface 32 at a distance sufficient to permit wiper member 18 to move into engagement with the upper extremity of the surface. Then, as device 10 is forced downwardly and as body 20 remains in engagement with surface 32, the outer tip 18*b* of member 18 will engage surface 32 and wipe the excess solution off surface 32 almost simultaneously with or immediately after the application of the solution to surface 32 by body 20 at a location below member 18. This series of steps continues until the entire area of surface 32 is cleaned. In this way, surface can be cleaned quickly and there is no need to first wash or scrub the entire surface area of surface 32 before wiping the excess solution therefrom. Thus, there is no substantial possibility that the solution will dry and thereby streak on surface 32 before member 18 wipes the excess solution off the surface.

Generally, the length of handle 12 will be in the range of 4 to 9 inches, more preferably 5 to 7 inches, to provide the necessary control over both member 18 and body 20 simultaneously. If handle 12 were too long, the simultaneous washing and wiping of the surface could not be properly controlled and it would be necessary then to first apply a cleaning solution to the surface by body 20 over generally the entire area of the surface followed then by the wiping action of member 18, a series of steps which is done conventionally with well known solution applying and wiping means.

Figure 5:
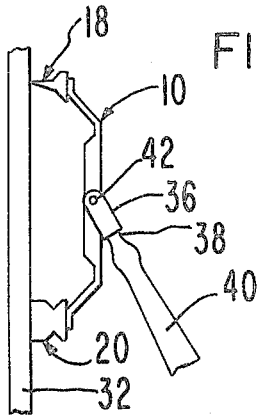
FIG. 5 is a view similar to FIG. 4 but showing the way in which the device is coupled to the outer end of a rod for cleaning of a surface at a distance from a user holding the handle.

If the surface 32 is a height generally taller than the person using device 10, the device 10 can be provided with a threaded attachment 36 as shown in FIG. 5 so that the upper end 38 of a long pole or rod 40 can be coupled with device 10 to manipulate it to reach locations out of the normal reach of the user. Fitting 36 can be mounted by a pin 42 and the fitting can be removably mounted on the device if desired so that the device can still be hand-held for other jobs.

What is claimed is:

1. A surface cleaning device comprising: an elongated handle having a pair of opposed ends; a first extension and a second extension secured to respective ends of the handle and extending outwardly therefrom on one side of the handle, each extension being at an acute angle with reference to the longitudinal axis of the handle; a first, hollow holding element secured to the outer end of the first extension; a wiper member extending into said first holding element and projecting outwardly therefrom in a direction substantially perpendicular to the longitudinal axis of the handle; a second, hollow holding element secured to the outer end of the second extension; a body of absorbent material, said body having a portion extending into said second holding element and projecting outwardly therefrom in a direction substantially perpendicular to the longitudinal axis of the handle, said handle adapted to be held by the hand and to be moved so as to move the wiper member and the body simultaneously along and in engagement with a surface to be cleaned, the length of the handle being in the range of 5 to 7 inches to allow the handle to be grasped by the hand in a manner to permit full control by the hand of the wiper member and the body at the same time during movement of the wiper member and the body simultaneously along and in engagement with the surface to be cleaned.

* * * * *